United States Patent [19]

Ishibashi et al.

[11] Patent Number: 4,846,085

[45] Date of Patent: Jul. 11, 1989

[54] METHOD FOR LINKING KNITTED FABRIC PIECES AND APPARATUS THEREOF

[75] Inventors: Tatsuhiro Ishibashi; Yutaka Masushige; Shotaro Kai, all of Nobeoka, Japan

[73] Assignee: Asahi Kasei Kogyo Kabushiki Kaisha, Osaka, Japan

[21] Appl. No.: 133,341

[22] Filed: Dec. 15, 1987

[30] Foreign Application Priority Data

Dec. 19, 1986 [JP] Japan ..... 61-301659
Dec. 23, 1986 [JP] Japan ..... 61-305535

[51] Int. Cl.[4] ..... D05B 5/00
[52] U.S. Cl. ..... 112/27; 112/262.1
[58] Field of Search ..... 112/25, 26, 27, 121.11, 112/121.12, 262.1

[56] References Cited

U.S. PATENT DOCUMENTS

| | | | |
|---|---|---|---|
| 2,290,123 | 7/1942 | Wilfong . | |
| 2,413,891 | 1/1947 | Roy . | |
| 2,948,240 | 8/1960 | Burd et al. . | |
| 3,834,331 | 9/1974 | Raisin et al. | 112/27 |
| 4,393,799 | 7/1983 | Matthews | 112/262.1 |
| 4,573,419 | 3/1986 | Peloggio | 112/27 |

FOREIGN PATENT DOCUMENTS

| | | |
|---|---|---|
| 2133363 | 1/1973 | Fed. Rep. of Germany . |
| 52-125052 | 10/1988 | Japan . |
| 203404 | 1/1938 | Switzerland . |
| 2058856 | 4/1981 | United Kingdom . |

OTHER PUBLICATIONS

"Development of Computer-Controlled Machinery for Making Up of Garments," IEEE Proceedings, vol. 132 Pt. D, No. 4, Jul., 1985.

*Primary Examiner*—Ronald Feldbaum
*Attorney, Agent, or Firm*—Finnegan, Henderson, Farabow, Garrett & Dunner

[57] ABSTRACT

A method for automatically linking corresponding knitted loops of two knitted fabric pieces, and an apparatus for implementing the method, wherein each knitted loop to be pierced in two knitted fabric pieces is pierced by a piercing needle, respectively, and the knitted loop in one knitted fabric piece held by the piercing needle of one knitted loops selecting and piercing device is transferred to a corresponding piercing needle already holding a corresponding knitted loop of another knitted fabric piece, and the two corresponding knitted loops are sewn by a sewing needle.

14 Claims, 20 Drawing Sheets

FLOW DIAGRAM OF KNITTED LOOPS SELECTING AND PIERCING OPERATION

METHOD FOR LINKING KNITTED FABRIC PIECES AND APPARATUS THEREOF

BACKGROUND OF THE INVENTION

1. Field of the Invention

This invention relates to a technique for sewing together two knitted fabric pieces.

More specifically, this invention relates to a method of automatically placing individual knitted loops of two knitted fabric pieces in a position at which they can be sewn together and automatically linking the knitted loops of the two fabric pieces, and an apparatus for implementing the method.

2. Description of the Related Art

Since a knitted fabric is flexible and can be expanded by applying a force to the knitted fabric, so that a dimension of the knitted fabric is easily changed, it is usually impossible to automatically sew together two knitted fabric pieces. Therefore, little progress has been made in automatic sewing techniques and this sewing is still performed by hand using a sewing machine and a proper tool.

More specifically, automation of the linking together of the individual loops of two knitted fabric pieces is very difficult, because it is necessary to position the individual knitted loops of the two knitted fabric pieces together before sewing. Therefore, the linking is usually performed as follows, using a linking machine. Namely, an operator selects each individual knitted loop of a knitted fabric piece and pierces the selected knitted loop with a corresponding piercing needle among a plurality of piercing needles arranged in a fixed frame, and then selects the individual knitted loops of another knitted fabric piece to be sewn together with the first piece and pierces the selected knitted loop with the piercing needle holding the knitted loop of the first knitted fabric piece. The operator then places the plurality of piercing needles holding the two knitted fabric pieces on a linking machine, and the two knitted loops of the two knitted fabric pieces are sewn by using the piercing needles as a guide.

The above-mentioned linking, especially the selecting of individual knitted loops and piercing the selected knitted loops with the piercing needles, is difficult and requires a high degree of skill and good eyesight, and if only one knitted loop among several knitted loops is not selected, the sewn two knitted fabric pieces come apart at the above nonselected knitted loop, and thus the goods produced have a poor quality. Further, since even if linking is performed by a skilled operator it requires much time, this linking work is a great obstruction to any improvement of the labor productivity in a knitted fabric sewing process.

To overcome the above-mentioned drawbacks in the knitted fabric sewing process, several methods of automating the linking have been proposed. For example a method of knitting socks in which a marking thread, e.g., a thread having a color or being a specially finished material different from threads used for knitting the sock and which can be discriminated from the threads for knitting the socks by a reflected ray, is knitted into portions of the socks to be linked, and the piercing work is performed by detecting the marked thread, is disclosed in Japanese Unexamined Patent Publication (Kokai) No. 52-125052. However since it is necessary to previously knit a marked thread into ends of the knitted fabric pieces in this method, this method can be used only when linking portions in a course direction of ends of the knitted fabric pieces, such as toe portions of socks or the like, and this method cannot be used when linking portions of a fully-fashioned sweater, for example, linking two shoulder portions of the bodice or linking the bodice and a sleeve, because the two shoulder portion to be linked and the bodice and the sleeve to be linked have curved edges, and it is difficult to knit the marked thread into those portions.

Further, since the piercing needles are pierced into the two knitted fabric pieces by placing the two knitted fabric pieces on top of each other so that the marked threads are aligned, this method can be used only when the pitch of the knitted loops in the two knitted fabric pieces to be joined is the same and the shapes of the knitted fabric pieces to be joined are symmetrical. Therefore this method cannot be used for linking a front bodice with a back bodice wherein the pitch of the knitted loops is different from that of the front bodice, and the shape thereof is different from that of the front bodice. Consequently, this method is not practical for use on an industrial scale.

A study of a sensor capable of detecting a knitted loop to be pierced and intended for use in automation of the linking is disclosed in IEE PROCEEDINGS Vol 132 No. 4 July 1985, by the Loughborough University of Technology in Great Britain, but this study was limited to the development of a sensor, and there is no publication disclosing an automatic apparatus using this sensor on an industrial scale.

SUMMARY OF THE INVENTION

It is a primary object of the present invention to provide a method of automatically selecting individual knitted loops of two flexible knitted fabric pieces and linking together the selected knitted loops of the two knitted fabric pieces, and an apparatus for implementing the method.

A second object of the present invention is provide a method of automatically linking not only two knitted fabric pieces having a linear linking line, but also linking a knitted fabric piece having a linear linking line with a knitted fabric piece having a curved linking line or linking two knitted fabric pieces having curved linking lines, and an apparatus for implementing the method.

A third object of the present invention is to provide a linking apparatus having a high productivity.

A method for automatically linking two knitted fabric pieces according to the present invention is comprised of the following steps:

(a) piercing at least one knitted loop to be first sewn together in a linking line between said two knitted fabric pieces with a piercing needle(s) of two knitted loops selecting and piercing devices arranged opposite to and spaced apart from each other and having a plurality of piercing needles capable of moving toward each knitted fabric piece, respectively;

(b) detecting an arrangement of knitted loops in the knitted fabric piece downstream from the knitted loop pierced in step (a), and calculating a location data of a knitted loop to be next sewn;

(c) sequentially guiding the knitted loop to be next sewn to a piercing position in accordance with the location data, by a knitted fabric piece guiding means, and sequentially piercing each knitted loop at the piercing position by the piercing needle;

(d) sequentially transferring the knitted loops held on the piercing needle of one of the two knitted loop selecting and piercing devices to the piercing needle of the other knitted loop selecting and piercing device and piling the two knitted fabric pieces;

(e) sewing the knitted loops defined by the piercing needles of the two knitted fabric pieces by a sewing device.

The guiding of the knitted loops performed by the knitted fabric piece guiding means is preferably performed by a coarse adjusting step of detecting a position of an edge of the knitted fabric piece, which is useful as an index of a knitted loop line to be pierced, and guiding the knitted fabric piece on the basis of the detected data, and a fine adjusting step of detecting a position of the knitted loop at a location near to the piercing position and guiding the knitted loop to the piercing position. It is possible to precisely select and pierce each knitted loop to be sewn by performing this two step guiding of the knitted loops.

BRIEF DESCRIPTION OF THE DRAWINGS

FIG. 20 is an enlarged view of a knitted loop at the piercing position a;

DESCRIPTION OF THE PREFERRED EMBODIMENTS

The present invention will be described in detail with reference to the accompanying drawings illustrating embodiments of an apparatus for implementing an automatic linking method in accordance with the present invention. Persons with skill in the art should understand that the automatic linking method in accordance with the present invention is not limited by the embodiments illustrated in the accompanying drawings.

Figure 1:
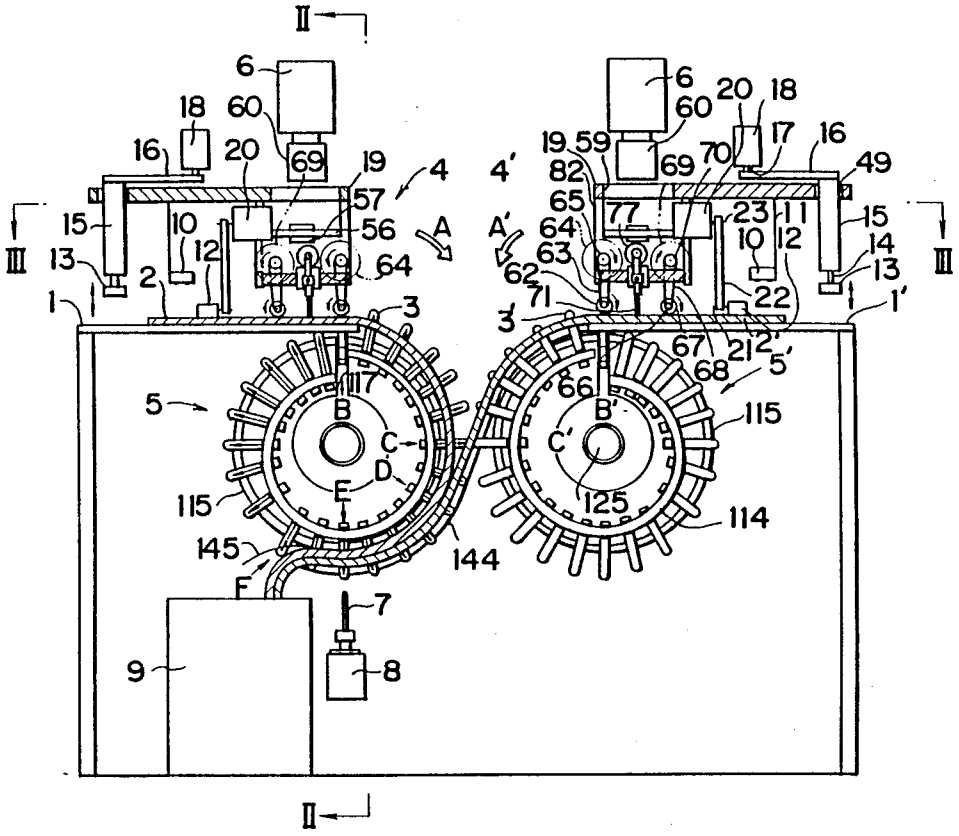
FIG. 1 is a front view of an embodiment of an automatic linking apparatus used to implement a linking method in accordance with the present invention, taken along the line I—I in FIG. 2.

FIG. 1 is a schematic illustration of an embodiment of an apparatus used to implement an automatic linking method in accordance with the present invention. This apparatus is referred to hereafter as an automatic linking apparatus. A pair of knitted loop selecting and piercing devices are arranged opposite to and spaced apart from each other in the automatic linking apparatus illustrated in FIG. 1. Each knitted fabric piece is supplied to each knitted loop selecting and piercing device.

Namely, the knitted fabric pieces 2 and 2' supplied from both sides on each working table 1 and 1' of the two knitted loops selecting and piercing devices arranged on the left and right in the figure are set on the automatic linking apparatus by piercing first one or several knitted loops, on a line linking the two knitted fabric pieces, with piercing needles 3 and 3', which is done by hand by an operator, respectively. The set knitted fabrics 2 and 2′ are sent in the directions A and A′ by a knitted fabric guiding means 4 and 4′ and a piercing needle transferring means 5 and 5′. Namely a camera 6 detects two-dimensional knitted loop data while an end of the knitted fabric piece is roughly adjusted, a knitted loop location is calculated on the basis of the two-dimensional knitted loop data, and a fine adjustment is made by which knitted loops to be pierced by a piercing needles 3 and 3′ is guided to a piercing position by the knitted fabric guiding means 4 and 4′ is performed. The piercing needles 3 and 3′ then pierce the corresponding knitted loops and are moved in the advancing direction A and A′ of the knitted fabric pieces 2 and 2′ by the piercing needle transferring means 5 and 5′.

By sequentially repeating the above-mentioned operation, the piercing operation on the piercing lines of the left side knitted fabric piece and right side knitted fabric piece are continued and the knitted fabric pieces 2 and 2′ are sent in the direction A and A′. During this advancing operation of the knitted fabric pieces 2 and 2′, the knitted loop pierced by the piercing needle 3′ of the knitted fabric piece 2′ is transferred to the piercing needle 3 holding the corresponding knitted loop of the knitted fabric piece 3 at a point shown by line C and C′ in FIG. 1, and the two knitted fabric pieces 2 and 2′ are piled together at a point shown by an arrow D and are sewn by a sewing needle 7 of a sewing device 8 at a point shown by an arrow E. The sewn two knitted fabric pieces 2 and 2′ are removed from the piercing needle 3 at a point shown by an arrow F and are dropped into a reserving box 9.

As described hereinbefore, the method in accordance with the present invention can automatically and accurately sew together the knitted loops to be linked and automatically drop the sewn two knitted fabric pieces into the reserving box, only by setting the first or several knitted loops of the two knitted fabric pieces on the piercing needles, respectively.

The constitutions of the means used in the above-mentioned automatic linking method, and the functions thereof, will be described in detail hereafter.

A knitted loop selecting and piercing device in an automatic linking apparatus used to implement the automatic linking method in accordance with the present invention is comprised of a means for detecting an arrangement of knitted loops in the knitted fabric piece (hereinafter, referred as "knitted loops arrangement detecting means"), a knitted fabric guiding means, and a piercing needle transferring means. First, an embodiment of the knitted loops arrangement detecting means and an embodiment of the knitted fabric guiding means for guiding the knitted fabric to a position in which a piercing operation can be performed, on the basis of data received from the knitted loops arrangement detecting means, will be described in detail by referring to FIGS. 1 to 3.

In the embodiment illustrated in FIG. 1, the knitted fabric guiding means is comprised of a fine adjusting means for adjusting in two dimensions the knitted fabric piece, on the basis of data received from the knitted loops arrangement detecting means before each knitted loop to be pierced arrives at a piercing position B or B′, and a coarse adjusting means for adjusting the curvature of the knitted fabric piece and aligning a linking line in a direction parallel to an advancing direction of the knitted fabric piece before the knitted fabric piece is adjusted by the fine adjusting means.

Figure 2:
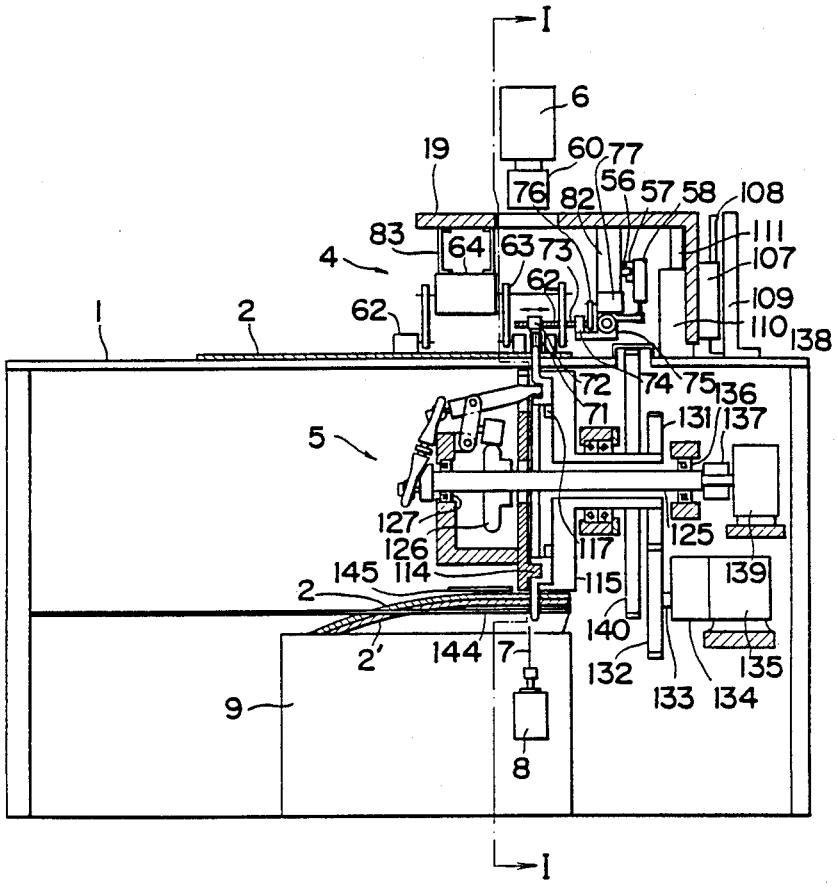
FIG. 2 is a side view of the automatic linking apparatus taken along the line II—II in FIG. 1.
Figure 3:
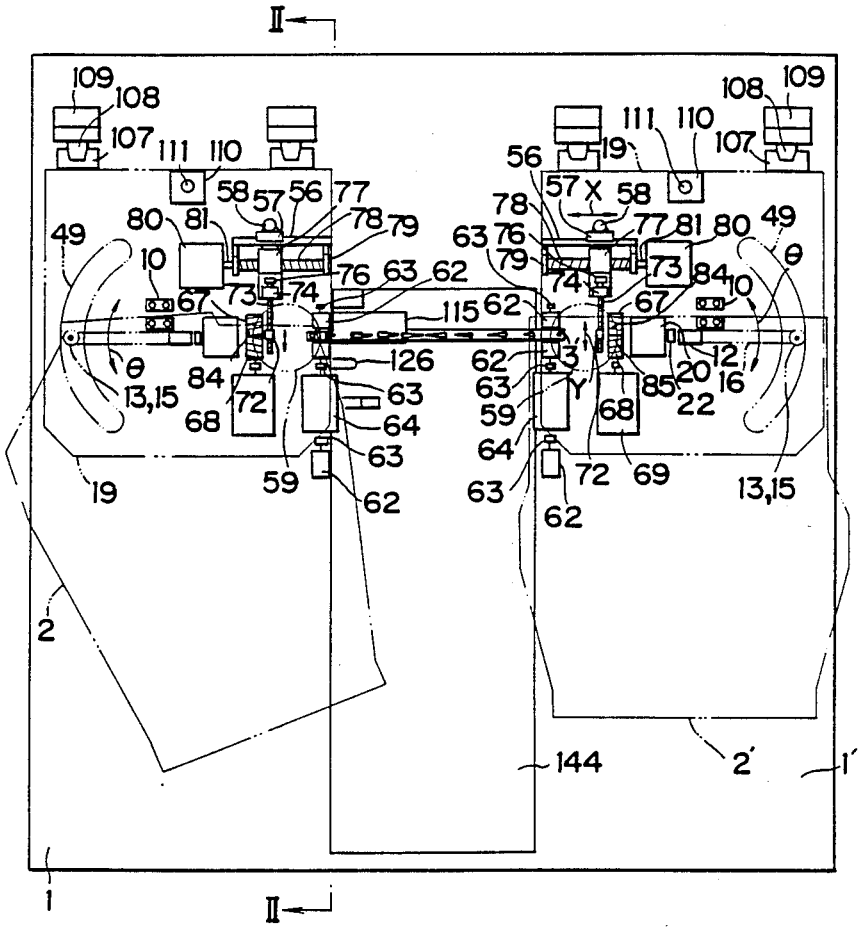
FIG. 3 is a plan view of the automatic linking apparatus taken along the line III—III in FIG. 1.

As illustrated in FIGS. 1, 2, and 3, the coarse adjusting means is comprised of a roller 12 for adjusting a position of an edge of the knitted fabric piece (hereinafter, referred to as "edge position adjusting roller 12") combined with a sensor 10 for detecting a position of an edge of the knitted fabric piece (hereinafter, referred to as "edge position detecting sensor 10") and a device for adjusting a direction of an edge of the knitted fabric piece (hereinafter, referred to as "edge direction adjusting device"). The edge position detecting sensor 10 is one of the knitted loops detecting means and is, for example, a reflection type photo sensor. In this case, the edge position adjusting roller 12 is moved by a motor 20 on the basis of signals emitted from two edge position detecting sensors 10 and moves the edge of the knitted fabric piece so that the edge is positioned at a position between the two edge position detecting sensors 10.

When the curvature of the linking line of the knitted fabric piece to be sewn is large, and it is impossible to adjust the edge position to a constant position only by operation of the edge position adjusting roller 12, the edge direction adjusting device may be used. The edge direction adjusting device is comprised of a tool 13 for adjusting the edge direction, an air cylinder 15, a rotatable arm 16, and a motor 18 as illustrated in FIG. 1. The tool 13 is arranged on an end of a cylinder rod 14 of the air cylinder 15 and can be held in a upward position apart from the knitted fabric piece when the curvature of the edge of the knitted fabric piece is not large and is pressed on the knitted fabric piece by the air cylinder 15 when the curvature of the edge of the knitted fabric piece is large. After the tool 13 is pressed on the knitted fabric piece, the tool 13 is rotated in a direction $\theta$ illustrated by an arrow in FIG. 3 through an arm 16 by a motor 18 fixed on a supporting member 19 through a suitable member (not shown), to adjust the edge of the knitted fabric piece.

Figure 4:
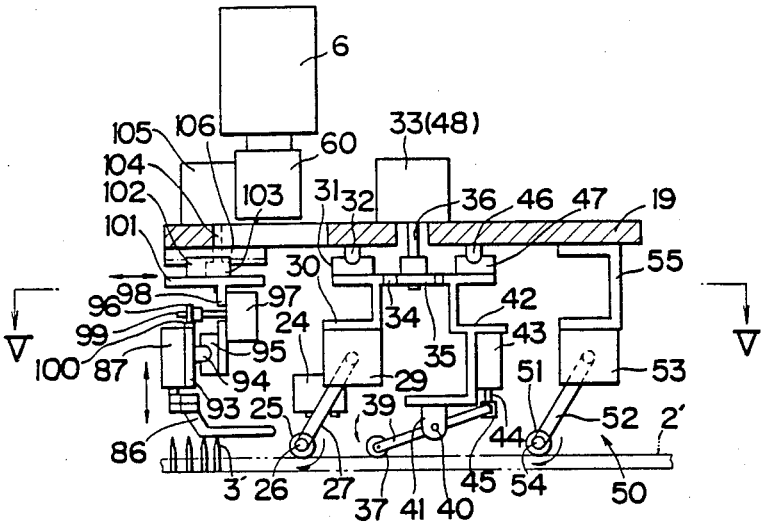
FIG. 4 is a front view of another embodiment of a knitting loop arrangement detecting means and a knitting loop guiding means taken along the line IV—IV in FIG. 5.
Figure 5:
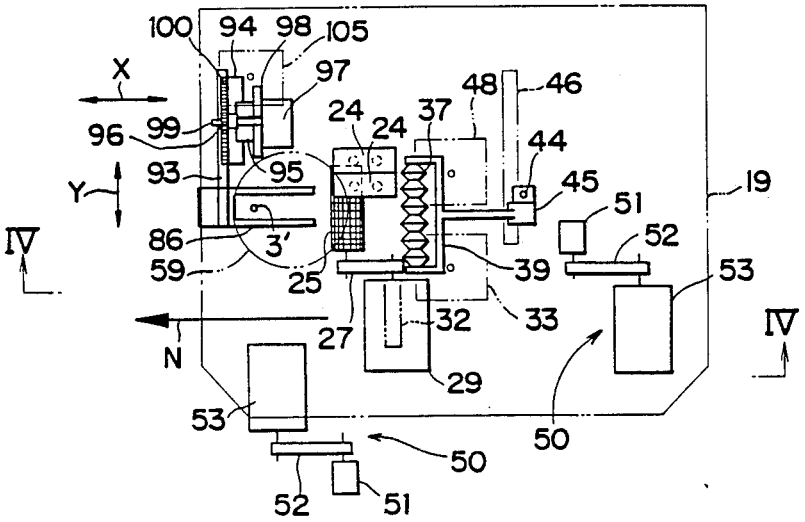
FIG. 5 is a plain view of the knitting loop arrangement detecting means and the knitted loop guiding means taken along the line V—V in FIG. 4.
Figure 6:
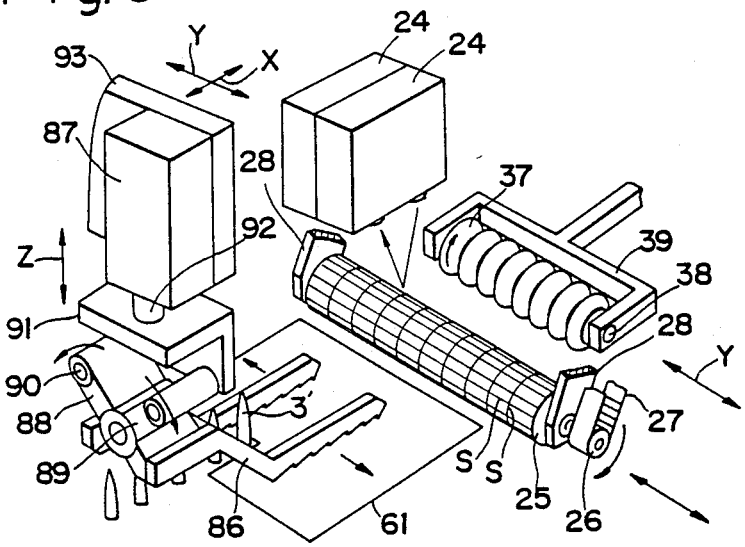
FIG. 6 is a perspective view illustrating in detail the knitted loop arrangement detecting means and the knitted loop guiding means shown in FIG. 4.

Another type of the coarse adjusting means comprising an edge position adjusting roller 37 combined with two edge position detecting sensors 24 constituting one of the knitted loop arrangement detecting means, and a device 50 for adjusting an arrangement of an edge of the knitted fabric piece (hereinafter, referred to as "edge arrangement adjusting device 50") are illustrated in FIGS. 4, 5, and 6. The edge position detecting sensor 24 is fixed on a supporting member 28 of a feed roller 25 through a suitable member (not shown in FIG. 6), and the edge position adjusting roller 37 is moved in the direction Y indicated by an arrow in FIG. 6 on the basis of signals received from the edge position detecting sensor 24, when pressed on the knitted fabric piece 2 through a cylinder rod 44, a rod end 45 and a rod 39 by an air cylinder 43, and is controlled by a controller (not shown) so that the edge is positioned between positions detected by two edge position detecting sensors 24. When the roller 37 is moved back in a direction opposite to the direction in which an adjustment movement is applied, the roller 37 is floated by the air cylinder 43.

As illustrated in FIG. 6, the roller 37 is constituted by a plurality of individually rotatable rollers supported on a shaft 38 and having a shape resembling that of a bead of an abacus. Even if different portions in a movement of the knitted fabric piece in the direction indicated by the arrow X in FIG. 6 appear due to an easy extendability of the knitted fabric piece, it is possible to prevent excess elongation by using the abacus type roller 37, in which each roller can be independently rotated. Therefore, preferably the roller 37 is a hard wearing material and is supported by a means in which each roller can be independently rotated.

The edge arrangement adjusting device 50 comprises a roller 51 driven through a timing belt 52 by a motor 53 and capable of moving the knitted fabric piece 2 toward the edge position adjusting roller 37 and the feeding roller 25. A length of advance of the knitted fabric pieces sent by the roller 51 is controlled by a controller (not shown) on the basis of data regarding moving length in the direction of Y of the edge position adjusting roller 37 and the moving direction thereof. Namely, when the knitted fabric piece having a straight linking line is sewn, the advancing length applied by the roller 51 is synchronized with the advancing length applied by the roller 25. However, when a knitted fabric piece having a curved linking line is sewn, for example, when a back bodice of a sweater is sewn to a front bodice or a sleeve of a sweater is sewn to the front bodice or the back bodice, a pair of edge arrangement adjusting devices 50 are used as illustrated in FIG. 5, two rollers 51 are rotated in directions different to each other end are controlled such that the edge position is under the edge position adjusting roller 37.

The fine adjustment of the knitted fabric piece, performed by using a camera in the knitted loops arrangement detecting means, and a picture processing device will be now described. A charge coupled device camera is usually used as a camera 6 illustrated in FIG. 1. The camera 6 is provided with a close-up lens 60 and arranged perpendicular to the knitted fabric piece on the supporting member 19, such that an image of the knitted loops can be obtained. A field of vision of the camera to be obtained as image data is determined so that the field of vision includes at least one knitted loop of the linking line to be pierced. To obtain a clear image, it is important to apply sufficient lighting, and preferably, a uniformly scattered light is transmitted onto the knitted fabric piece from a back side of the knitted fabric piece toward the camera 6. One example of an arrangement of lighting area 61 is illustrated in FIG. 6.

The fine adjusting means illustrated in FIG. 1 comprises rollers 62 and a roller 67 sending the knitted fabric piece in the advancing direction and a hand 71 adjusting a knitted loop to be pierced in a direction perpendicular to the advancing direction of the knitted fabric piece, i.e., the direction indicated by the arrow Y in FIG. 3. The rollers 62 and 67 are driven by motors 64 and 69, respectively. The motors 64 and 69 may be capable of changing the number of rotation thereof, and a pulse motor is used in this embodiment. To obtain a clear image, preferably the knitted fabric pierce is expanded, and therefore, preferably there is difference in the rotational speeds of the roller 62 and the roller 67. Further, preferably two spiral grooves 84 and 88 having different angles inclined to the axis or a surface of the roller 67 are provided.

The hand 71 is connected with a ball screw 73 through a bearing 72, so that the hand 71 can be reciprocally moved in the direction Y (in FIG. 3). Further as illustrated in FIG. 3 the hand 71 can be moved in the direction X by connecting a boss 74 of the ball screw 73 to another ball screw 78. Thus, the hand 71 can be moved in the direction X and the direction Y, i.e., in a two-dimensional fashion. Further, the hand 71 can be moved in a vertical direction by moving a bearing 75 of the ball screw 78 by an air cylinder 58 supported with a linear bearing 57 capable of moving on a rail 56. The rail 56 is connected, through a supporting member 82, with the supporting member 19. The ball screw 73 is rotated through a timing belt 76 by a motor 77 and the ball screw 78 is rotated through a motor shaft 81 by a motor 80.

Another type of the fine adjusting means comprising the feed roller 25 feeding the knitted fabric piece in the advancing direction and a hand device 86 capable of expanding a portion of the knitted fabric piece including the knitted loops to be pierced in the direction Y, and moving in the direction X and the direction Y, are illustrated in FIGS. 4, 5 and 6.

As indicated by a mark S in FIG. 6, the feed roller 25 has a plurality of cylindrical grooves and axial grooves, and the feeding roller 25 is driven through a timing belt 27 and a pulley 26 by a motor 29. The feed roller 25 and the edge position detecting sensor 24 are supported on the supporting member 28, and the supporting member 28 and the motor 29 are supported on the supporting member 30. The supporting member 30 is slidably supported in the direction Y on a rail 32 by a linear bearing 31 thereof and is moved by meshing a rack 34 fixed on the supporting member 30 with a pinion 35 fixed on a shaft 36 of a motor 33.

As can be clearly seen in the perspective view of FIG. 6, the hand device 86 is comprised of two arms capable of expanding the knitted fabric piece while pressing the knitted fabric piece on the plate 61 used as the lighting area 11 and holding the knitted fabric piece in the expanded state. In this hand device 86, two arms are arranged in parallel to each other in a direction parallel to the advancing direction of the knitted fabric piece and can be moved in the direction Z by an air cylinder 87. The two arms can be further moved in the direction X and the direction Y when the air cylinder 87 is supported through a supporting member 93 with a rack 100 and a rail 94 by a linear bearing 95 and is driven through a pinion 96 fixed on a motor shaft 99 by a motor 97 fixed on the linear bearing 95, and when the motor 97 is supported through a supporting member with a rack 101 and a linear bearing 102 by a rail 106 fixed on the supporting member 19 and is driven through a pinion 103 fixed on a motor shaft 104 passing through the supporting member 19 by a motor 105 (see FIG. 4). The two arms of the hand device 86 press down the portion including the knitted loops to be pierced in the knitted fabric piece to expand the portion in the direction Y. After receiving the position data of the knitted loop to be pierced from the knitted loops arrangement detecting means, the hand device 86 moves in the direction X and in the direction Y on the basis of the position data so that the knitted loop to be pierced is correctly guided to a piercing position. After performing a piercing operation, the hand device 86 is pulled up from the pressing position by the air cylinder 87.

As described hereinbefore, it is possible to guide the knitted loops on the linking line to the piercing position by using only the hand device 86, however, it is possible to obtain a more precise guiding of the knitted loops by combining the feed roller 25 and the hand device 86. Namely, sometimes a length to be adjusted in the direction Y is too large and this large length cannot be adjusted only by the hand device 86. In this case, preferably the feed roller 25 is moved in the direction Y by driving the motor 33 to minimize a necessary adjusting length to be adjusted by the hand device 86 and to adjust the remaining length to be adjusted by the hand device 86. By using this method, it is possible to correctly adjust the position of the knitted loop to be pierced for the knitted fabric piece having an edge with an extremely small curvature.

Further it is possible to correctly adjust the position by allowing the hand device 86 to rotate about an axis in the direction Z. Namely, in this case, an inclination angle Q between the linking line and the advancing direction of the knitted fabric piece is observed, and then the hand device 86 is rotated by the angle Q on the basis of the observed data, to expand and hold the knitted fabric piece. The hand device 86 is controlled such that the above angle Q become zero when guiding and adjusting the knitted fabric piece to the piercing position.

The knitted loops arrangement detecting means and the knitted fabric guiding means are fixed on the supporting member 19, and the supporting member 19 is provided with a raising and descending mechanism. Namely, as illustrated in FIG. 2, the supporting member 19 is slidably supported through a linear bearing 107 and a rail 108 by an upright 109 and can be moved in a vertical direction through a rod 111 by an air cylinder 110. Therefore, it is possible to raise the knitted loops arrangement detecting means and the knitted fabric guiding means when initially setting the knitted fabric piece on the linking apparatus. Accordingly, it is possible to easily perform the initial setting in the linking apparatus in accordance with the present invention.

When linking two knitted fabric pieces, for example, when linking a front bodice and a back bodice of a sweater, by using the knitted loops arrangement detecting means and the knitted fabric guiding means, often the linking line of knitted fabric pieces is curved. In this case, the knitted fabric pieces are processed by adjusting the edge of the knitted fabric piece by the coarse adjusting means, so that the edge is moved to a position under the sensor 10 or 24. By this operation, the linking line becomes almost parallel to the direction X in a field of vision of the camera 6 and a detection performed by an image processing of the knitted loop to be pierced becomes easy. Knitted loops arrangement data of the piercing position and a position just before the piercing position is detected by a camera 6, position data of the knitted loops is calculated by an image processing device on the basis of the data obtained by the camera 6, the position of the knitted fabric piece is moved two dimensionally by using the hand 71 and the feed roller 62 and 67, or the hand device 86 and the feed roller 25, to guide the knitted loop to be pierced to the piercing position, and then the piercing operation is performed. When an end portion of the linking line is to be pierced, it is possible to pierce all of the knitted loops on the linking line by moving the hand 71 or the hand device 86 in the direction X. Note, where a change of the curvature of the linking line is not large, the coarse adjusting means may be omitted.

Figure 18:
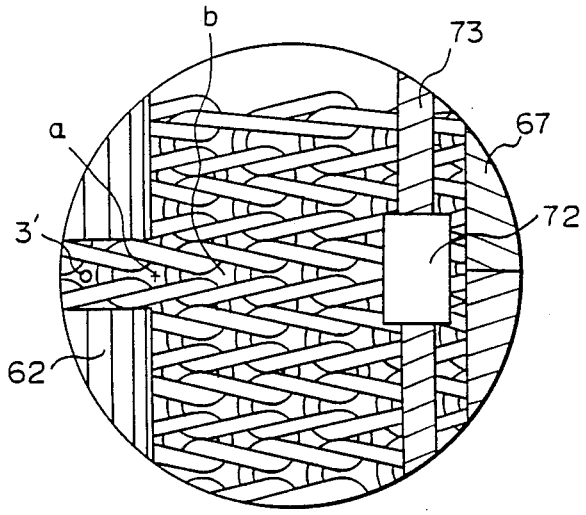
FIG. 18 is a view illustrating a knitted loops image obtained by a camera.
Figure 19:
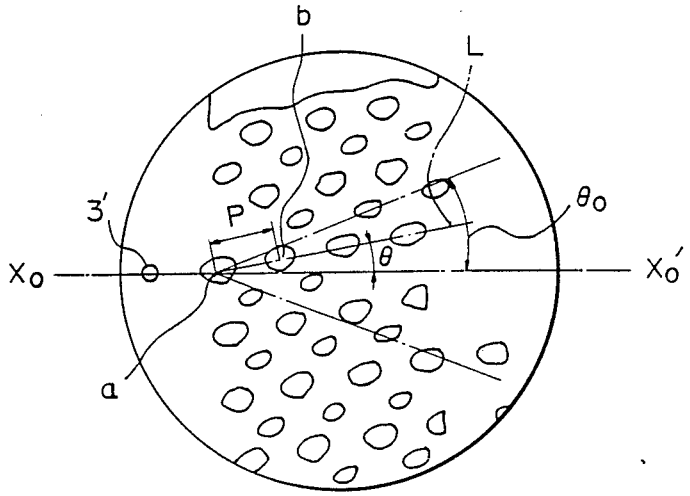
FIG. 19 is a view illustrating a picture obtained by processing the image shown in FIG. 18 and for explaining a knitted loop guiding method performed by using the knitting loop guiding means shown in FIG. 1.
Figure 20:
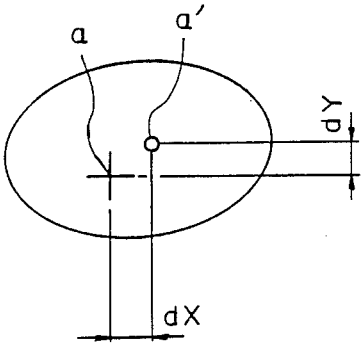

Next a calculation of the position data of the knitted loops and the guiding of the knitted fabric piece performed on the basis of the position data will be described in detail. The detected image of the knitted loops is obtained as illustrated in FIG. 18. A hole b, i.e., a knitted loop is made clearly visible as illustrated in FIG. 19, by processing by an image processing device, and a two-dimensional position data of the knitted loops in the field of vision of the image is precisely obtained by calculating a center of gravity in the hole b. When the piercing position is a point a in FIG. 19, since the linking line a—L in the field of vision of the image is already adjusted within the angle $Q_0$ against a standard line $X_0$—X'0 by the coarse adjusting means, a knitted loop nearest to the point a and within the angle of $\pm Q_0$ against the standard $X_0$—X'0 is obtained as a knitted loop b to be pierced in a next step. The binary position data including a distance between the point a and the point b and an angle Q is input to a controller, i.e., microcomputer, and the binary position data is converted to values to be processed by the fine adjusting means. The knitted fabric piece is guided so that the knitted loop to be pierced in the next step is moved to the point a by operating the fine adjusting means on the basis of the obtained values.

Figure 21:
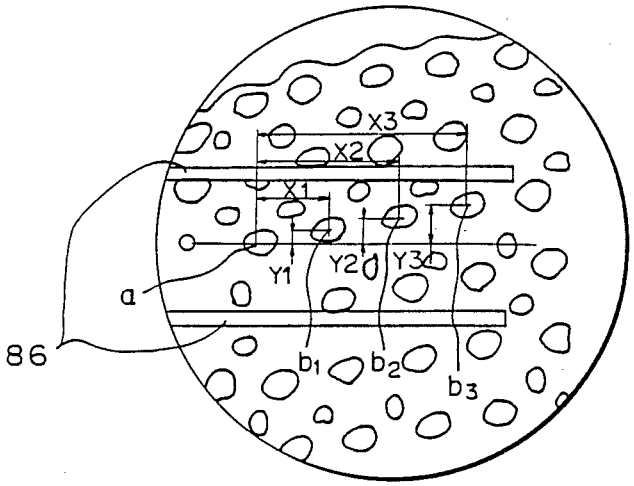
FIG. 21 is a view of a picture obtained by processing the knitted loops image, and explaining a knitted loop guiding method performed by using the knitted loop guiding means shown in FIG. 4.

When the hand device 86 illustrated in FIG. 6 is used as the knitting fabric guiding means for finely adjusting the knitted fabric piece, an image of the knitted loops is obtained in a state illustrated in FIG. 21. A knitted loop to be pierced is detected logically in the same manner as that described hereinbefore, and the obtained two-dimensional position data is calculated as the distances from the point a in the direction X and the direction Y. The knitted fabric piece is guided by moving the hand device 86 by the above distances so that the knitted loop to be pierced moves to the point a, and a piercing operation is performed.

In the above description, one knitted loop to be pierced is detected in one image processing. However it is possible to detect a plurality of knitted loops to be pierced sequentially in the one image processing. For example, when three knitted loops to be pierced are detected as illustrated in FIG. 21, the obtained two-dimensional position data $(x_1, y_1)$, $(x_2, y_2)$ and $(x_3, y_3)$ is input to and processed by the microcomputer. Therefore, the guiding and piercing operation of the knitted fabric pieces can be sequentially performed for every three knitted loops by using this method, and it is possible to perform the knitted loop selecting and piercing process at a high speed.

Figure 25:
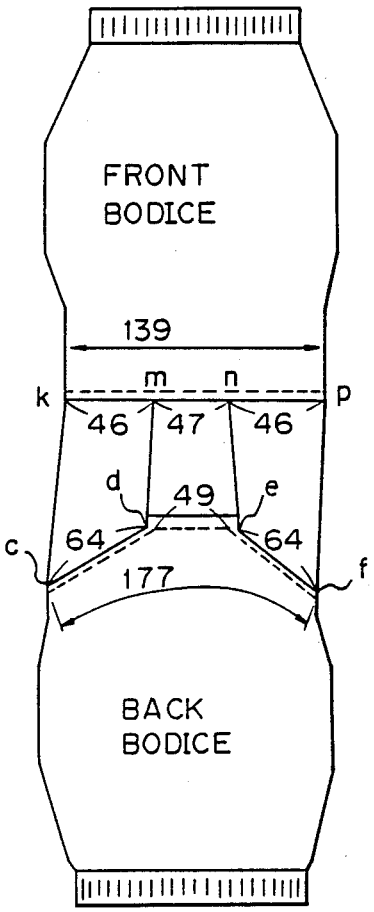
FIG. 25 is a view of an example of the number of the knitted loops of a front bodice and a back bodice to be sewn when the front bodice and the back bodice are sewn at a shoulder portion.
Figure 26:
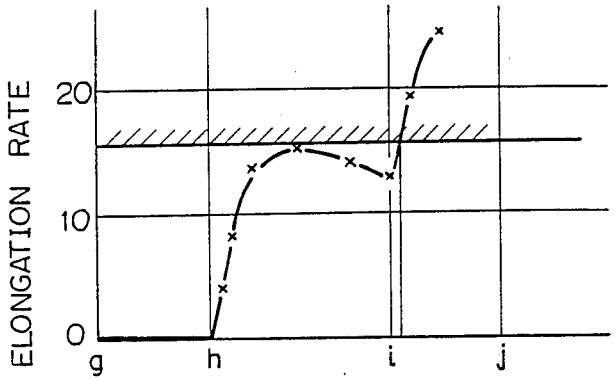
FIG. 26 is a graph illustrating a relationship between an elongation rate of a knitted loop line to be used as a piercing line in a sleeve and a restricting length in a direction of a straight line upon linking the sleeve with the front bodice.

When a linking operation of a shoulder portion or a sleeve portion of a fully fashioned sweater is performed, there are positions where at the angle of the linking line (illustrated as a broken line in FIG. 25) is changed suddenly, as illustrated as points d and e in FIG. 25 illustrating a front bodice, and a back bodice to be linked with the front bodice, and as illustrated as points h and i in FIG. 26 illustrating a sleeve. The detection of the knitted loop to be pierced in those cases can be performed by using a fact that the position of the knitted loop to be pierced in a next step is within a predetermined geometrical dimension on the basis of a knitted fabric design data. Further, it is possible to more precisely detect the knitted loop to be pierced in the next step by detecting a deflecting angle at a point where the linking line is folded, by performing a special image processing and surveying the knitted loop to be pierced in the next step by using the data obtained in the special image processing.

When a knitting fabric piece having a fine gauge in which a pitch between two adjacent knitted loops is small is used, it is necessary to increase the precision of the positioning of the knitted loop to be pierced at the piercing position a. In this case, after applying the above-mentioned adjusting procedure to the knitted fabric piece, a fine detecting procedure of detecting a position a' of an adjusted knitted loop is applied to the knitted fabric piece so that minor errors dX and dY between the piercing position a and the position a' can be obtained. Then, a fine adjustment of the knitted fabric piece on the basis of the values dX and dY is made, before the piercing operation.

When linking a shoulder portion of the fully fashioned sweater, as clearly illustrated in FIG. 25, the lengths between two portions of two knitted fabric pieces to be pierced are not the same. For example, the length between point c and point d in the back bodice is not the same as that between point k and a point m in the front bodice. These differences appear in the relationships between points d and e and points m and n, and between points e and f and points n and p, respectively. Therefore, the number of knitted loops between the corresponding portions of two knitted fabric pieces is not the same, and when linking the above-mentioned portions to each other, it is necessary to position the portion at point c and point h, point d and point m, point e and point n, point f and point p, respectively, and to sew the above-mentioned portion so that excess stretching or slack do not occur in these portions.

Since the number of knitted loops in the portion can be obtained from design data of the sweater at the time of sewing the knitted fabric pieces, the above-mentioned problems can be resolved by performing the knitted loop selecting and piercing operation so that, when piercing the portion between the point c and the point d in the back bodice, the piercing operation for one knitted loop is passed after a piercing operation for three knitted loops is continued, or after a piercing operation for two knitted loops is continued, by the knitted loop selecting and piercing device on the left of the linking apparatus in accordance with the present invention, by inputting the design data of the sweater to the linking apparatus, while when piercing a corresponding portion between point h and point m, a piercing operation for each knitting loop is continued by the knitted loop selecting and piercing device on the right of the linking apparatus and transferring the knitted loops of the knitting fabric piece held by the piercing needles on the right hand knitted loop selecting and piercing device to the piercing needles on the left hand knitted loop selecting and piercing device.

The linking apparatus in accordance with the present invention has two knitted loops selecting and piercing devices, and it is possible to pierce the piercing needle in the corresponding knitted loop with a mutually different pattern on the basis of the design data of the supplied knitted fabric piece. Therefore, an automatic linking operation for linking lines having a complicated pattern, e.g., a linking line in the shoulder, the sleeves, or the like, which can be only performed conventionally by a hand operated linking machine, becomes possible by using the linking machine in accordance with the present invention.

It is preferable to use an exclusive image processing device to raise the processing speed, but a general-purpose image processing device which can be obtained on the market may be used for the linking machine in accordance with the present invention.

A method in which a plurality of touch needle sensors are arranged in a two-dimensional manner and positions of the knitted loops are calculated from the difference between concave portions and convex portions of the knitted fabric piece, or a method in which a laser beam is applied to the knitted fabric piece and positions of the knitted loops are calculated by processing data obtained by the portion of the laser beam passing therethrough or reflecting therefrom, can be used as the means for detecting an arrangement of the knitted fabric in a two-dimensional manner. Further, a method for calculating the positions of the knitted loops by using a linear array sensor, as described in the report by Loughborough University, can be implemented.

A piercing needle transferring means will be now described with reference to FIGS. 7 to 16.

Figure 8:
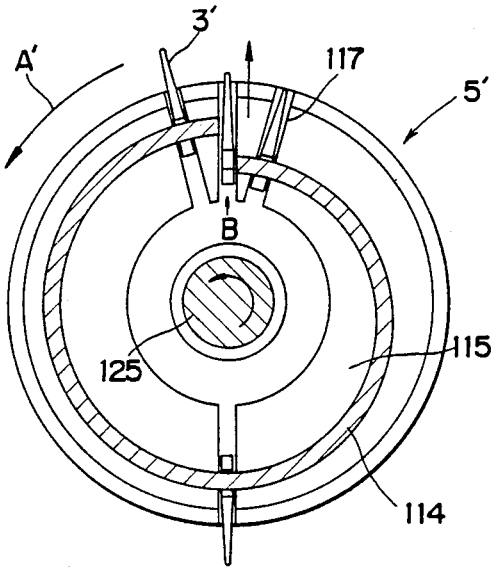
FIG. 8 is a front view illustrating an embodiment of a means for engaging the piercing needles with a fixed guide.
Figure 9:
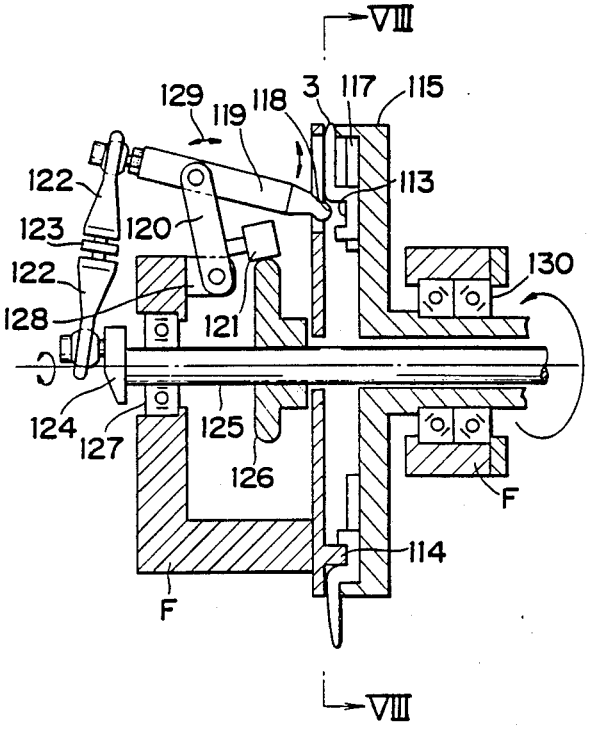
FIG. 9 is a cross-sectional view illustrating in detail a piercing needle raising mechanism in the piercing needle transferring means.
Figure 10:
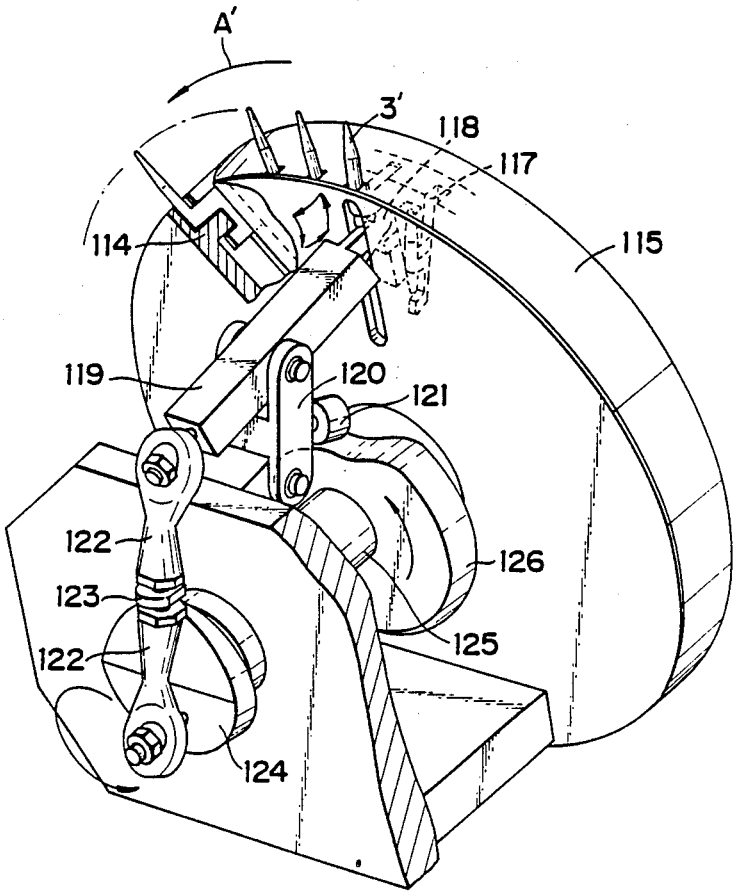
FIG. 10 is a perspective view illustrating a state in which the piercing needle is raised by the piercing needle raising mechanism shown in FIG. 9.
Figure 11:
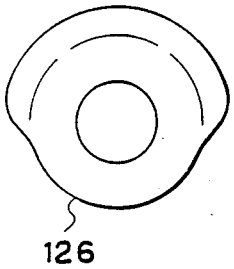
FIG. 11 is a front view illustrating a shape of a cam used in the piercing needle raising mechanism shown in FIG. 9.
Figure 12:
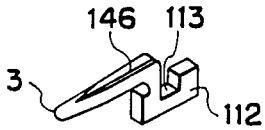
FIG. 12 is a perspective view illustrating an embodiment of a piercing needle.

One embodiment of the piercing needle transferring means 5 is illustrated in a cross-sectional view of FIG. 9. A piercing needle 3 is fixed on a holding member 112, and a groove 113 of the holding member 112 is such that the groove 113 can be slidably engaged with a stationary guide 114. A rotational drum 115 is provided with a plurality of slits 117 (see FIG. 7) having a distance corresponding approximately to a pitch between the knitted loops. When the rotational drum 115 is rotated in the direction A', the piercing needle 3 is moved in an advancing direction of the knitted fabric piece by being pressed from a side face of the slit 117 and is also raised outward while being guided by the stationary guide 114. As illustrated in FIG. 8, the stationary guide 114 starts from a position downstream from a piercing position and has a circular locus having the same radius from a center of the rotational drum 115 in an area between the piercing position and 180° from the piercing position so that a raising state of the piercing needle is kept in this area. The stationary guide 114 is formed in an area between a position downstream from 180° and a position near to the piercing position such that the piercing needle protruded from the rotational drum 115 is gradually allowed to descend toward the center of the rotational drum 115. After the piercing needle has descended to a position where the piercing needle does not touch the knitted fabric piece at a position upstream from the piercing position B', the piercing needle 3 is removed from the stationary guide 114 and a top end 118 of a protruding lever 119 is inserted into the groove 113 of the piercing needle 3.

The piercing needle 3 is protruded by rotation of a shaft 125 caused by a connecting rod 122 fixed on a point displaced from a center of rear end of the shaft 125 and a lever supporting member 120 or the like, then guided to the stationary guide 114, and starts the above-mentioned rotational movement. The lever 119 protruding the piercing needle 3 is swung in the direction indicated by an arrow 129 through a cam follower 121 and the lever supporting member 120 by an eccentric cam 126, and the top end 118 of the lever 119 is removed from the groove 113 of the piercing needle 3. While the lever 119 is held in this state, the rotational drum 115 is rotated to a next position in which a next piercing needle is to be protruded. The eccentric cam 126 is formed in a shape illustrated in FIG. 11 to apply the above-mentioned movement to the lever 119. The above-mentioned mechanism for performing the raising and descending movement of the piercing needle will be easily understood from the perspective view of FIG. 10.

The rotational movement of the rotational drum 115 and the protruding movement of the piercing needle 3 may be performed by the same motor or may be performed by two individual motors. For example, the rotational drum 115 may be driven through gears 131, 132 by a motor 135 with a reducing device 134, and the shaft 125 applying the protruding movement to the piercing needle 3 may be supported by bearings 127 and 136 and may be driven through a coupling 137 by a motor 139 as illustrated in FIG. 2. When two motors are used as described hereinbefore, it is important to electrically synchronize the drives of the two motors, to eliminate interference in the movements of the two motors.

Figure 16:
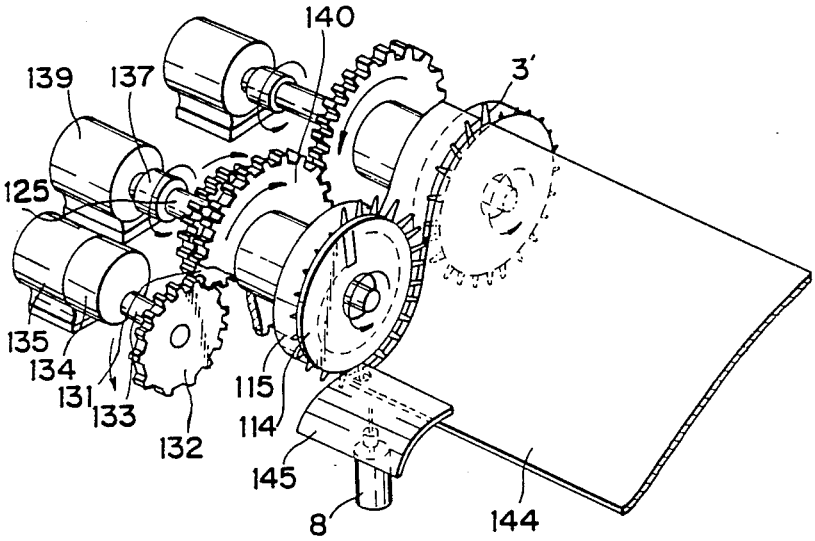
FIG. 16 is a perspective view illustrating a drive mechanism used in the piercing needle transferring means shown in FIG. 1.

The two knitted loop selecting and piercing devices should be driven in synchronization. Therefore, each rotational drum constituting the knitted loop selecting and piercing device may be connected by gears 140, to obtain the synchronized movement, as illustrated in FIG. 16.

Figure 13:
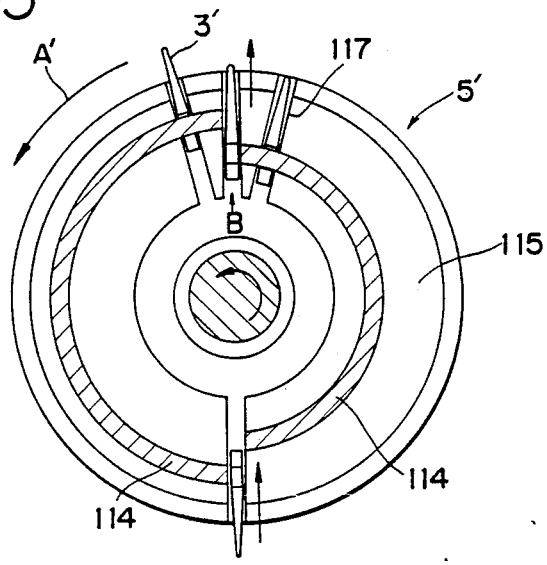
FIG. 13 is a front view illustrating another embodiment of a means for engaging the piercing needles with a fixed guide, and including a piercing needle descending means.
Figure 7:
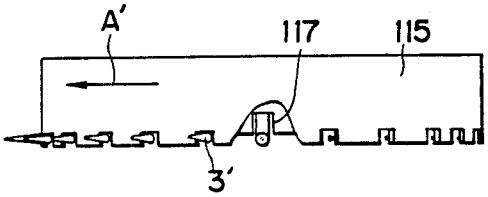
FIG. 7 is a cross-sectional view illustrating a piercing needle transferring means in the linking apparatus shown in FIG. 1.
Figure 14:
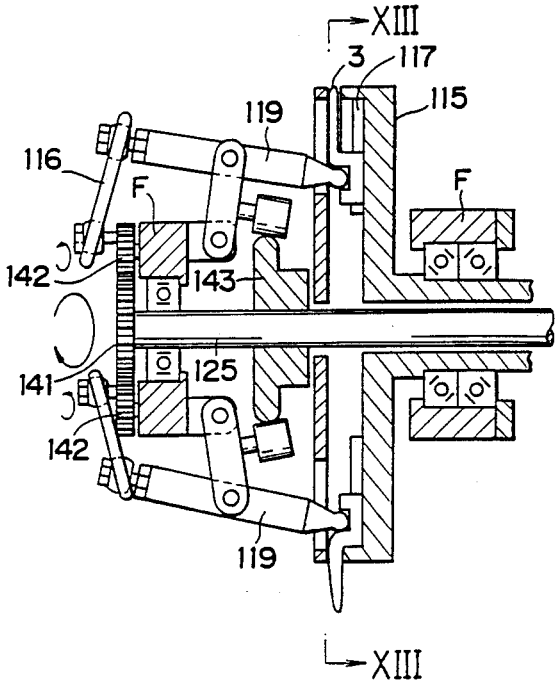
FIG. 14 is a cross-sectional view illustrating a piercing needle transferring means including the piercing needle raising mechanism and the piercing needle descending means.
Figure 15:
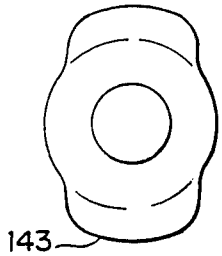
FIG. 15 is a front view illustrating a shape of a cam used in the piercing needle transferring means shown in FIG. 14.

Another embodiment of the rotational drum 115, in which the piercing needle protruding mechanism and a piercing needle drawing mechanism having a constitution similar to that of the piercing needle protruding mechanism are provided, is illustrated in FIGS. 13 and 14. The piercing needle drawing mechanism may be arranged at a position opposite to a position of the rotational drum 115 where the piercing needle protruding mechanism is arranged. In this case, a gear 141 is arranged on an end of the shaft 125, idle gears 142 are arranged on a frame F, respectively, the gear ratio between the gear 141 and the gear 142 is determined as 2:1, and a convex cam 143 having two convex portions on a symmetrical portion thereof as illustrated in FIG. 15 is used. The lever 119 can be moved in one reciprocal movement by a half rotation of the shaft 125 by using the above-mentioned constitution, and the piercing needle protruding movement and the piercing needle withdrawing movement can be simultaneously performed. By arranging the piercing needle withdrawing mechanism, it is possible to constitute the stationary guide 114 with two concentric circles having different diameters as illustrated in FIG. 13, and it is possible to decrease frictional resistance between the stationary guide 114 and the groove 113 compared with the stationary drum illustrated in FIG. 8.

Figure 27:
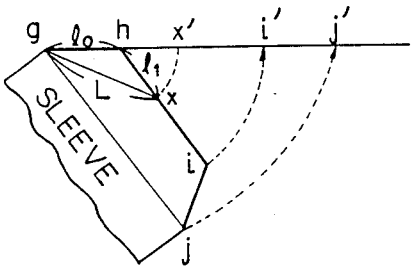
FIG. 27 is a view illustrating a shape of a sleeve to be linked.

When a knitted fabric piece having a curved edge is held by the rotational drum, preferably the diameter of the rotational drum is as small as possible, to minimize deformation of the knitted fabric piece. Namely, in FIG. 1, a length in which the knitted fabric piece is restricted is from a piercing needle protruding position B' through a point C to a point E where a sewing device is arranged and corresponds to a half of the circumference of the rotational drum 115. This length may be limited to a small length when a knitted fabric piece having a curved edge, e.g., a sleeve, is to be sewn. This necessary limitation will be explained in detail with reference to FIGS. 26 and 27. A relationship between an elongation rate of a knitted loop line to be used as a piercing line in a sleeve and a restricting length in a direction of a straight line upon linking the sleeve with the front bodice is illustrated in FIG. 26. A shape of the sleeve to be linked is illustrated in FIG. 27. The elongation rate is calculated by the following expression:

$$\text{Elongation rate} = \frac{l_0 + l_1 - L}{L} \times 100$$

wherein the lengths $l_0$, $l_1$, and L are as expressed in FIG. 27.

The elongation rate of the knitted fabric in the length L between the point g and the point x appears when each point h, i, j is restricted in the straight line, as illustrated in FIG. 26. An upper limitation of the elongation rate of the knitted fabric when a sleeve of a lady's medium size polo sweater is linked is about 15% to 16%, therefore it is not preferable to stretch the knitted fabric over the point i in FIG. 26. This length, i.e., summation of the length between the point g and the point h and the length between the point h and the point i in the sleeve of the lady's polo sweater, is about 324 mm. A diameter of the rotational drum in which a half circumference of the drum corresponds to the length of 324 mm in the sleeve is about 206 mm. Further, if the sewing point E in FIG. 1 is shifted in a counterclockwise direction by 45°, the restricting length corresponding to $\frac{3}{8}$ of the circumference of the rotational drum and the diameter of the rotational drum becomes about 275 mm. In view of the above, when a normal sweater or the like is sewn, preferably the diameter of the rotational drum is less than 300 mm. In this case, a knitted loop at a point j may be restricted after a knitted loop restricted at the point g is removed.

Two knitted fabric pieces pierced by the piercing needle of the two knitted loop selecting and piercing devices, respectively, should be placed together before sewing by a sewing device. For performing this process, two knitted loop selecting and piercing devices 5 and 5' are arranged such that each piercing needle 3 and 3' is aligned at the line C and C' and a cover plate 144 having a shape corresponding to a transferring curve of the two knitted fabric pieces is arranged as illustrated in FIGS. 1 and 16, and the knitted loop of the knitted fabric piece 2' pierced in the piercing needle 3' of the right side knitted loop selecting and piercing needle device 5' is transferred to the corresponding piercing needle 3 holding the knitted loop of the knitted fabric piece 2 at the left side knitted loop selecting and piercing needle device 5. Further it is preferable to arrange means capable of positively pressing the knitted loop into the corresponding piercing needle at a position near to a point D (see FIG. 1).

The two knitted fabric pierces having knitted loops on the linking line thereof held on the piercing needles 3 are transferred to a point E by the rotation of the rotational drum 115, and each knitted loop on the linking line is sewn by a sewing needle 7.

Note, another piercing needle transferring means including a mechanism for protruding the piercing needle and a mechanism capable of aligning each piercing needle of the two knitted loop-selecting and piercing devices can be used in place of the piercing needle transferring means described hereinbefore.

Figure 17:
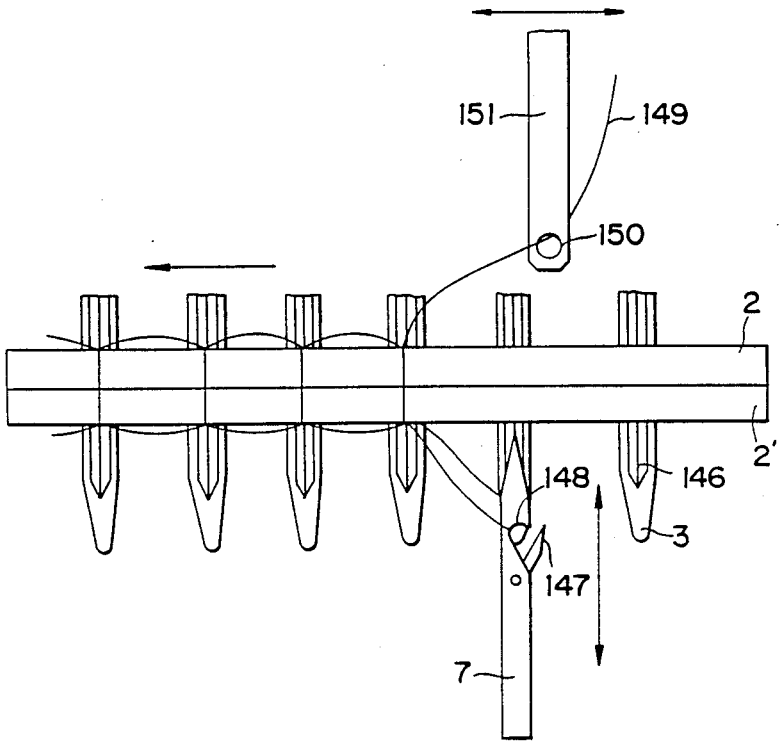
FIG. 17 is a front explanatory view of a linking operation for sewing together two knitted fabric pieces.

An embodiment of a sewing operation is illustrated in FIG. 17. A sewing needle 7 having a latch 147 is introduced into the knitted loops of the two piled knitted fabric pieces by being guided therein by a V-shape groove 146 of piercing needle 3 holding the knitted fabric. At that moment, the latch 147 has been opened by the knitted loop, and a thread feed guide 151 is swung so that a sewing thread 149 is hooked by a hook 148 of the latch needle 7. When the latch needle 7 is returned, the latch 147 is closed by the knitted loop into which the latch needle was introduced, and the sewing thread 149 is introduced to the corresponding knitted loop to accomplish a sewing loop. The next knitted loops to be sewn are advanced to a position above the sewing needle 7 by the rotation of the rotational drum, and by repeating the above processed, a sewing procedure along the linking lines of two knitted fabric pieces is performed as illustrated in FIG. 17.

It is necessary to match the timing of the sewing needle with the transferring timing of the piercing needle. Therefore, the same motor may be used to drive the rotational drum and the sewing needle, and a cam, a link mechanism, or the like used to drive the sewing needle.

When two motors are used separately, it is necessary to match electrically the drive motions of the two motors.

Figure 28:
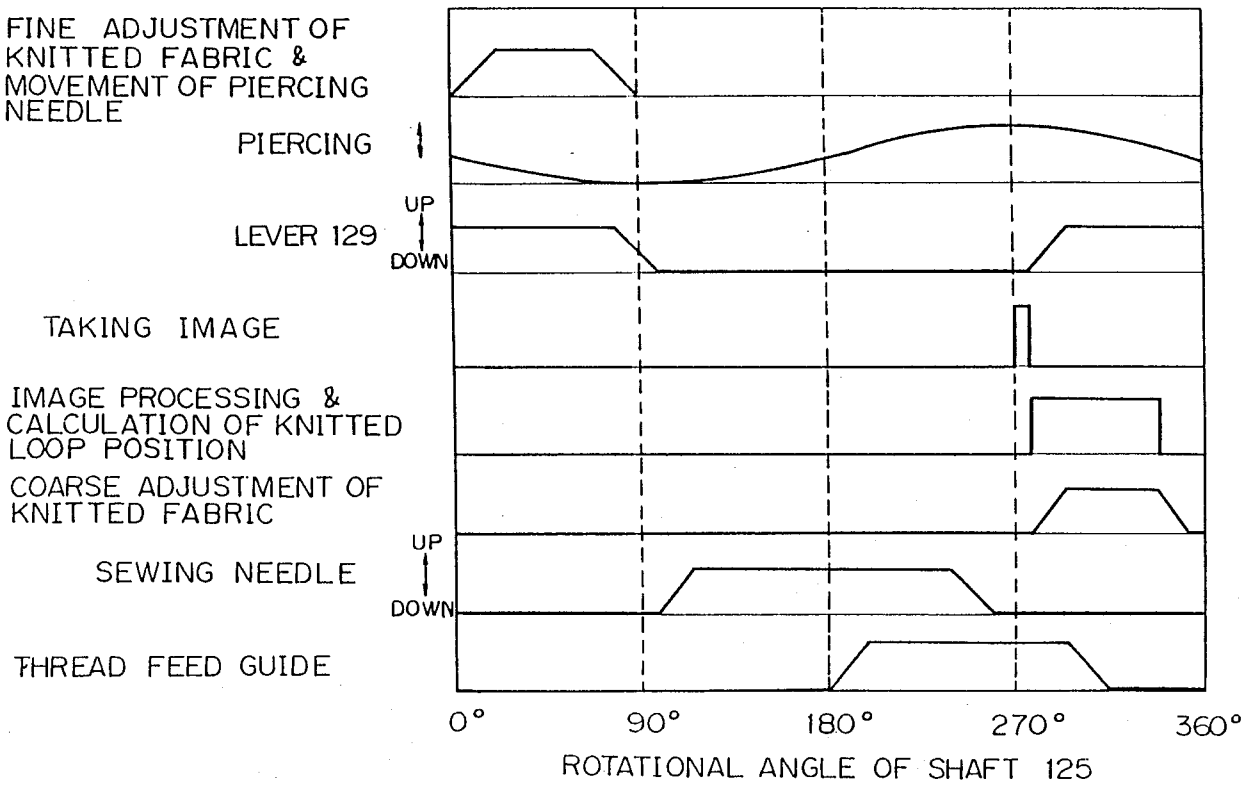
FIG. 28 is a chart diagram illustrating the motion timing of members constituting the linking apparatus, on the basis of a rotational angle of a shaft (125) of the piercing needle transferring means.

An example of a timing chart in the operation of each member or mechanism in the linking apparatus in accordance with the present invention is illustrated in FIG. 28.

The case when the two knitted pieces are sewn by a single chain stitch is illustrated in FIG. 17. However a double chain stitch may be applied. With regard to a mechanism and an arrangement of the sewing machine, there is no limitation and all sewing machines capable of sewing with a suitable chain stitch may be used. Further, the V-shape groove 146 of the piercing needle 3 may be omitted from the piercing needle 3' arranged on the right side rotational drum.

The two sewn knitted fabric pieces are removed from the piercing needle 3 by being guided with a guiding plate 145 and reserved in a reserving box.

In the description with reference to the drawings, the linking apparatus in which a table set with the knitted fabric pieces is arranged in a horizontal plane is described. However the linking apparatus in accordance with the present invention can be used in an upright arrangement by arranging the table in a vertical position, arranging the piercing needle transferring means in a horizontal plane, and slightly modifying the knitted fabric guiding means so that the means can be used in the vertical plane.

Figure 22:
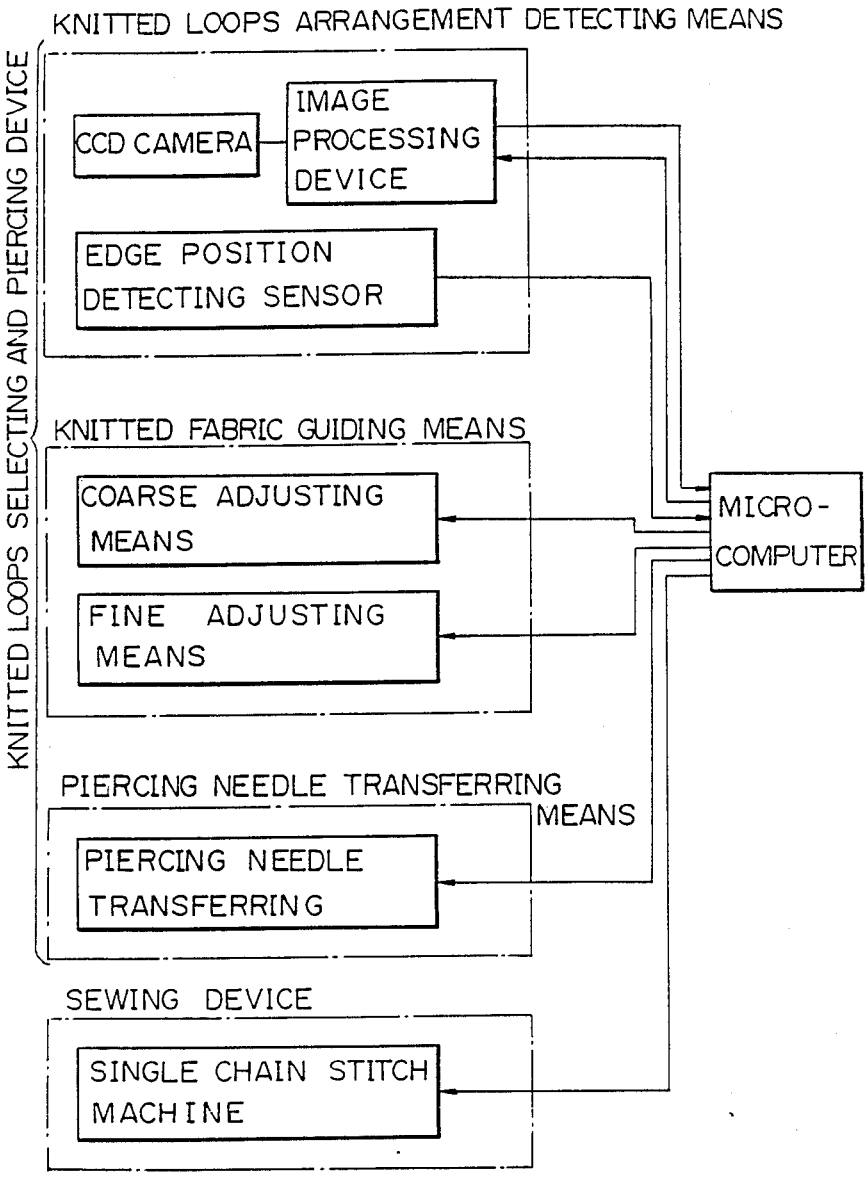
FIG. 22 is a diagram illustrating an operation of a linking apparatus in accordance with the present invention.

A diagram for explaining an operation of the linking apparatus in accordance with the present invention is illustrated in FIG. 22. As illustrated in FIG. 22, a microcomputer for controlling each unit constituting the linking apparatus is connected to each unit, data emitted from the edge position detecting sensor of the knitted loops arrangement detecting means or the image processing device is input to the microcomputer, and after being suitably processed in the microcomputer, instructions are output to the knitted fabric guiding means, the piercing needle transferring means, and the sewing device, and thus the above-mentioned linking operation is sequentially performed.

Figure 23:
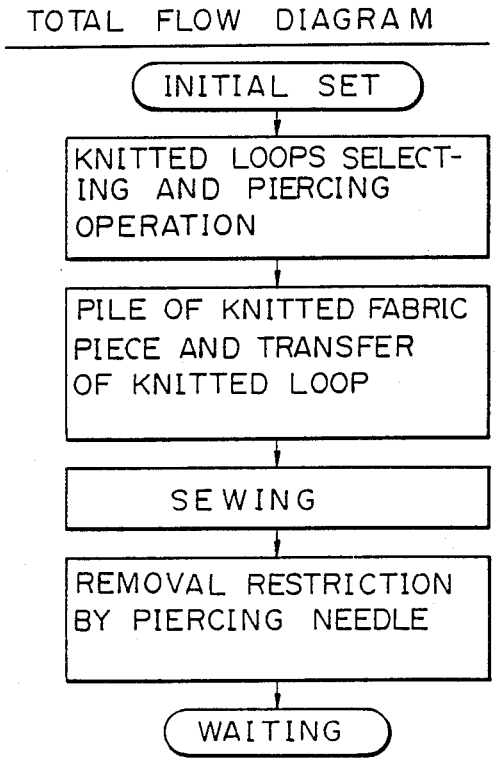
FIG. 23 is a flow diagram illustrating the entire linking operation in accordance with the present invention.
Figure 24:
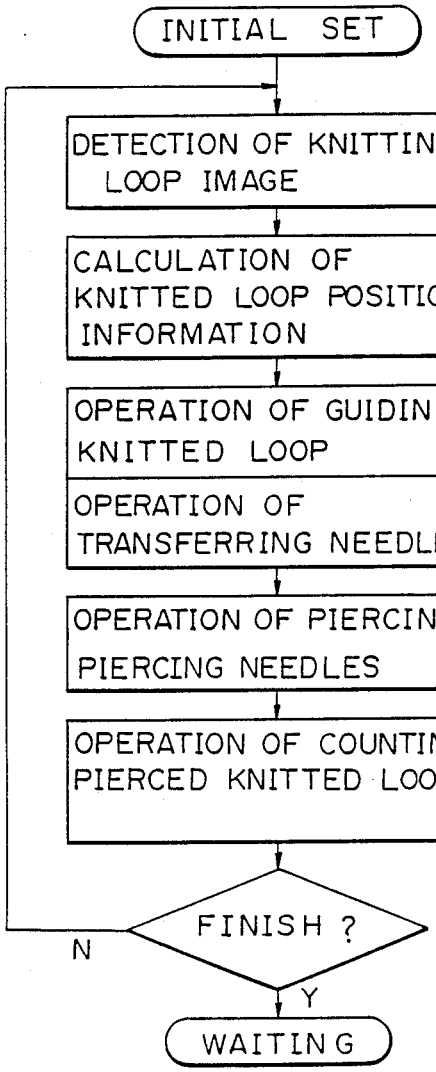
FIG. 24 is a flow diagram illustrating in detail the knitted loop selecting and piercing operation in the flow diagram shown in FIG. 23.

A total flow diagram is illustrated in FIG. 23, and a flow diagram of a knitted loop selecting and piercing operation is illustrated in FIG. 24.

Note, if necessary, the rotational drum 115, the piercing needle 3 and 3', and the sewing needle 7 in the linking apparatus in accordance with the present invention may be optionally exchanged with parts corresponding to the knitted fabric pieces to be sewn together. Therefore, the linking apparatus can be applied to various types of the knitted fabrics having different gauges, i.e., different distance between adjacent knitted loops.

To compare the efficiency of a linking operation using the linking apparatus in accordance with the present invention with the efficiency of a manual linking operation, the following test was performed:

A CCD camera, a picture processing device, and a reflective type photo sensor for detecting an edge of a knitted fabric piece were used as the knitted loops arrangement detecting means, a plurality of rollers were used as a knitted fabric guiding means, and stepping motors were used as the driving source. Piercing needles were moved by a mechanism including a cam and link mechanism, and the diameter of a rotational drum was 136 mm. The number of piercing needles was 120, and a sewing machine using a single chain stitch was used. All the movements of the units were controlled by a 16 bit microcomputer.

The time required for linking a lady's sweater by using the linking apparatus in accordance with the present invention was compared with the time required by an ordinary manual linking operation. The results are shown in Table 1.

TABLE 1

| Sewn position | Shoulder | Sleeve |
|---|---|---|
| Present invention | 2.5 ~ 3 min | 5 ~ 6 min |
| Comparative example | 4.7 ~ 5.9 min | 10 ~ 11.6 min |

Since a linking operation can be automatically performed by only setting two knitted fabric pieces on the linking apparatus in accordance with the present invention, it is possible to realize a large reduction of labor productivity by using the linking method or the linking apparatus in accordance with the present invention, and if it is possible to automate the first setting operation of the knitted fabric pieces, full automation of the sewing process can be obtained.

Further, since it is possible to accurately perform the knitted loops selecting and piercing operation, the problems of sewing quality are minimized.

The knitted loops selecting and piercing operation can be simultaneously applied at both sides of the linking apparatus, and therefore, the efficiency of the sewing operation is doubled compared to that of the ordinary manual linking operation.

We claim:

1. Method for automatically linking two knitted fabric pieces comprising the following steps:

(a) piercing at least one knitted loop to be first sewn together in a linking line between said two knitted fabric pieces with a piercing needle(s) of two knitted loop selecting and piercing devices arranged opposite to and spaced apart from each other and having a plurality of piercing needles capable of moving toward said knitted fabric piece, respectively;

(b) detecting an arrangement of knitted loops in the knitted fabric piece downstream from the knitted loop pierced in said step (a), and calculating location data of a knitted loop to be next sewn;

(c) sequentially guiding said knitted loop to be next sewn to a piercing position in accordance with said location data by a knitted fabric piece guiding means and sequentially piercing said each knitted loop at a piercing position by said piercing needles;

(d) sequentially transferring knitted loops held on the piercing needle of one of the two knitted loops selecting and piercing devices to the piercing needle of the other knitted loops selecting and piercing device and piling the two knitted fabric pieces; and (e) sewing the knitted loops defined by the piercing needle of the two knitted fabric pieces by a sewing device.

2. A method according to claim 1, wherein step (d) is performed by selecting the knitted loops to be sewn in accordance with said location data on the basis of design data of knitted fabric pieces which are different from each other so that the piercing operations for both knitted fabric pieces are performed in a different manner.

3. A method according to claim 1, wherein said location data of the knitted loop to be sewn is detected for a plurality of knitted loops at one detecting operation so that said guiding operation and said piercing operation can be continuously performed.

4. A linking apparatus for linking two knitted fabric pieces comprising two knitted loops selecting and piercing devices arranged opposite to and spaced apart from each other and including a plurality of piercing needles capable of moving back to a piercing position by a movement in a same direction after removal from the piercing position, and capable of moving in a lengthwise direction of the piercing needle, at least one sensor for detecting an arrangement of knitted loops in the knitted fabric piece, an arithmetical unit for calculating a location data of the knitted loop to be sewn, at least one guiding means for guiding the knitted fabric piece such that the knitted loop to be sewn is moved to a piercing position and a means for raising the piercing needle into the corresponding knitted loop at the piercing position, a means for transferring the knitted loop held on the piercing needle of one of the two knitted loops selecting and piercing devices to the piercing needle holding the knitted loop in the other knitted loops selecting and piercing device and piling the two knitted fabric pieces together, and a sewing device arranged at a position downstream from the position in which the two knitted fabric pieces are piled and chain-stitching together each knitted loop of said piled two knitted fabric pieces.

5. A linking apparatus according to claim 4, wherein a rotatable dish having a diameter of 300 mm or less is used as a means for supporting said plurality of piercing needles.

6. A linking apparatus according to claim 4, wherein said knitted loops selecting and piercing device further includes a means for lowering the piercing needle from the corresponding knitted loops.

7. A linking apparatus according to claim 4, wherein said sensor is a CCD camera capable of detecting the knitted loop as a point in a plane, and said arithmetical unit is a picture processing device capable of processing an image obtained by said CCD camera.

8. A linking apparatus according to claim 4, wherein a coarse adjusting means for guiding a knitted loop to be sewn to a position near to a linking line, and a fine adjusting means arranged at a position downstream from the coarse adjusting means and for guiding the knitted loop to be sewn from said position near to the linking line to a position on the linking line are provided as said guiding means.

9. A linking apparatus according to claim 8, wherein said coarse adjusting means comprises a sensor for detecting a position of an edge of a knitted fabric piece, a roller for adjusting the position of the edge of the knitted fabric piece, and a device for adjusting a direction of the edge of the knitted fabric piece.

10. A linking apparatus according to claim 8, wherein said coarse adjusting means comprises a sensor for detecting a position of an edge of a knitted fabric piece, and a rolling device comprising a plurality of individually rotatable rollers supported on a shaft and having a shape resembling a bead of an abacus.

11. A linking apparatus according to claim 8, wherein said fine adjusting means comprises a rotatable roller having an axis perpendicular to a direction of the linking line and capable of moving in the direction of said axis, and two spiral grooves having different angles inclined to the axis are provided on a cylindrical surface of the rotatable roller so that the knitted fabric pieces can be spread.

12. A linking apparatus according to claim 8, wherein said fine adjusting means comprises a hand device having two parallel hands capable of changing a distance thereof, so that said hand device can guide the knitted fabric piece to the piercing position while expanding and holding the knitted fabric piece under a compression condition.

13. A linking apparatus according to claim 12, wherein said hand device is provided with a rotational mechanism capable of rotating said hand device about an axis perpendicular to a plane including said two parallel hands.

14. A linking apparatus according to claim 12, wherein said fine adjusting means further comprises a roller capable of moving in a direction perpendicular to a direction of the linking line and having a plurality of cylindrical grooves and axial grooves.

* * * * *